US010329729B2

(12) United States Patent
Teague et al.

(10) Patent No.: US 10,329,729 B2
(45) Date of Patent: Jun. 25, 2019

(54) FOUNDATION PIER SYSTEM AND METHOD

(71) Applicants: Jeffrey W. Teague, Cleveland, MO (US); Vincent E. Branaman, Harrisonville, MO (US)

(72) Inventors: Jeffrey W. Teague, Cleveland, MO (US); Vincent E. Branaman, Harrisonville, MO (US)

( * ) Notice: Subject to any disclaimer, the term of this patent is extended or adjusted under 35 U.S.C. 154(b) by 44 days.

(21) Appl. No.: 15/653,322

(22) Filed: Jul. 18, 2017

(65) Prior Publication Data

US 2017/0314225 A1 Nov. 2, 2017

Related U.S. Application Data

(63) Continuation-in-part of application No. 15/171,901, filed on Jun. 2, 2016, now Pat. No. 9,708,788.

(60) Provisional application No. 62/170,090, filed on Jun. 2, 2015.

(51) Int. Cl.

| | |
|---|---|
| ***E02D 5/38*** | (2006.01) |
| ***E02D 5/04*** | (2006.01) |
| ***E02D 5/28*** | (2006.01) |
| ***E02D 5/32*** | (2006.01) |
| ***E02D 5/44*** | (2006.01) |
| ***E02D 5/52*** | (2006.01) |
| ***E02D 5/60*** | (2006.01) |
| ***E02D 27/48*** | (2006.01) |
| ***E04H 12/22*** | (2006.01) |

(52) U.S. Cl.

CPC ..... *E02D 5/385* (2013.01); *E02D 5/04* (2013.01); *E02D 5/28* (2013.01); *E02D 5/32* (2013.01); *E02D 5/44* (2013.01); *E02D 5/526* (2013.01); *E02D 5/60* (2013.01); *E02D 27/48* (2013.01); *E04H 12/2276* (2013.01); *E02D 2300/002* (2013.01); *E02D 2300/0029* (2013.01); *E02D 2600/20* (2013.01)

(58) Field of Classification Search

CPC .. E02D 5/385; E02D 5/44; E02D 5/04; E02D 5/28; E02D 5/32

USPC ..... 405/231

See application file for complete search history.

(56) References Cited

U.S. PATENT DOCUMENTS

| | | | |
|---|---|---|---|
| 7,429,149 | B2 | 9/2008 | Price et al. |
| 2008/0317556 | A1 | 12/2008 | Price |

*Primary Examiner* — Tara Mayo-Pinnock

(74) *Attorney, Agent, or Firm* — Law Office of Mark Brown, LLC; Christopher M. DeBacker

(57) ABSTRACT

A concentrically loaded foundation pier system which includes several concentrically stacked steel pipes filled with concrete. The entire pier is installed centrally beneath the footing of the structure. Shims are placed between the top-most pier element and a pier cap which prevents shifting when the soil expands and contracts. The final structure is end-loaded and pressed to the bedrock or other load-bearing strata. An alternative embodiment includes a temporary lifting assembly which can be fastened about the structural pier without need for bolts or other fasteners.

13 Claims, 21 Drawing Sheets

FOUNDATION PIER SYSTEM AND METHOD

CROSS-REFERENCE TO RELATED APPLICATION

This application is a continuation-in-part of and claims priority in U.S. patent application Ser. No. 15/171,901, filed Jun. 2, 2016, now U.S. Pat. No. 9,708,788, issued Jul. 18, 2017, which claims priority in U.S. Provisional Patent Application No. 62/170,090, filed Jun. 2, 2015, both of which are incorporated herein by reference.

BACKGROUND OF THE INVENTION

1. Field of the Invention

The present invention relates generally to a foundation pier system, and more specifically to a concentrically loaded pier system with pier cap and lifting assembly subsystems and methods of use thereof.

2. Description of the Related Art

When constructing buildings or other large structures, movement of that structure due to soil movement and compression is a common concern. It is common to offset these issues with piers, piles, and other foundation elements constructed beneath the structure which penetrate deeper into the earth. Typically a borehole is drilled into the ground, and then concrete and reinforcing (e.g. steel rebar) are placed into the bore. These foundation elements help to compensate for poor surface soil conditions and large structural design loads.

Typical existing piers and piles include several variations, each having its own issues. The helical pier suffers from uneven loading and requires that the footing of the structure be compromised. Concrete shoring pads do not penetrate the earth deep enough for many structures and therefore suffer from shifting soil. Concrete pilings suffer a similar fate. Drilled concrete piers are located at a fixed depth at all times, and this depth may be incorrect. Offset steel piers again require that the footing of the structure be compromised when installed, and suffer from uneven loading.

The angle of the shaft on a prior-art drilled concrete pier is not completely vertical, which compromises durability. Drilled concrete piers are drilled to a fixed depth, which very often is not the correct depth. Drilled concrete piers are friction piers meaning they rely on the soil to create friction and press against them to hold them in place. Soil shrinks and expands depending on weather conditions, which will cause them to fail. Drilled concrete piers require a long project time. To start the holes will be drilled, and then the concrete is poured. Next the concrete needs to dry for a week or longer in order to cure and raise the structure. The drilled concrete piers typically require large excavating equipment which is invasive to the homeowner's property.

The prior-art concrete piling pier is made of only concrete and susceptible to cracking and weathering over time. Concrete piling piers are friction piers which rely on the soil to hold them in place. There is a huge design flaw with this system. When the soil gets wet or dry it will expand and contract causing it to lose friction. This means it will eventually fail. This is a common problem with these piers because they rely on the soil which is always changing. The concrete piling pier's shims are not contained, which means that even slight movements in the soil can cause the shims to misalign and cause settlement. The shims on concrete piling piers are often intentionally broken on the job site with a hammer so that they fit correctly. This creates an uneven surface that allows for very little contact between the shim and concrete block, decreasing the strength of the pier.

The prior-art offset steel piers have hollow steel tubing and only use steel in their construction. The offset steel pier is installed on the side of the footing rather than underneath, therefore structural loads do not transfer directly onto the pier. This makes the spot directly under the bracket vulnerable to breaking under pressure. The offset steel pier has a steel bracket with up to a four inch offset which makes them vulnerable to buckling directly beneath the bracket. The majority of foundation repair companies that use the offset steel pier need to use large excavating equipment to install their piers. This requires more money which translates to an increase in their pier pricing. It also increases the chance of damaging a property.

Other prior art systems attempt to improve upon the basic structural pier or pile. These include staged piers having lifting assemblies including jacks mounted directly below the structure. The lifting platform using the jacks can be a problem when the jacks are not properly utilized, resulting in an unstable structure while the pier is being constructed beneath the lifting platform.

What is needed is a foundation pier system including a pier cap subsystem for providing superior stability for the building structure.

Heretofore there has not been available foundation pier system and method of use thereof with the advantages and features of the present invention.

SUMMARY OF THE INVENTION

The present invention generally provides a concentrically loaded foundation pier system which includes several concentrically stacked steel pipes filled with concrete. The entire pier is installed centrally beneath the footing of the structure. Shims are placed between the top-most pier element and a pier cap which prevents shifting when the soil expands and contracts. The final structure is end-loaded and pressed to the bedrock or other load-bearing strata.

It should be noted that the present invention is not limited to a single shape or size, and could be larger or smaller than indicated in the following example. A preferred embodiment of the present invention is installed by first digging a 3'×3' hole to access the bottom of a footing or beam of a structure. This may be achieved from inside or outside of the structure. Approximately 28 inches of working room below the structure is required for this example. A hydraulic pump is used to install the various components. The concentrical pier segments are driven into the ground one at a time until bedrock, load-bearing strata, or an installed base is reached. The lifting platform is temporarily attached to the driven pier in order to start the lifting process. The jacks of the lifting platform are set against the structure and act to lift the structure. Once the structure has been lifted an appropriate amount, the pier cap and shims are installed onto the end of the pier. The lifting platform may then be removed.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Foundation Pier System 2

Figure 1:
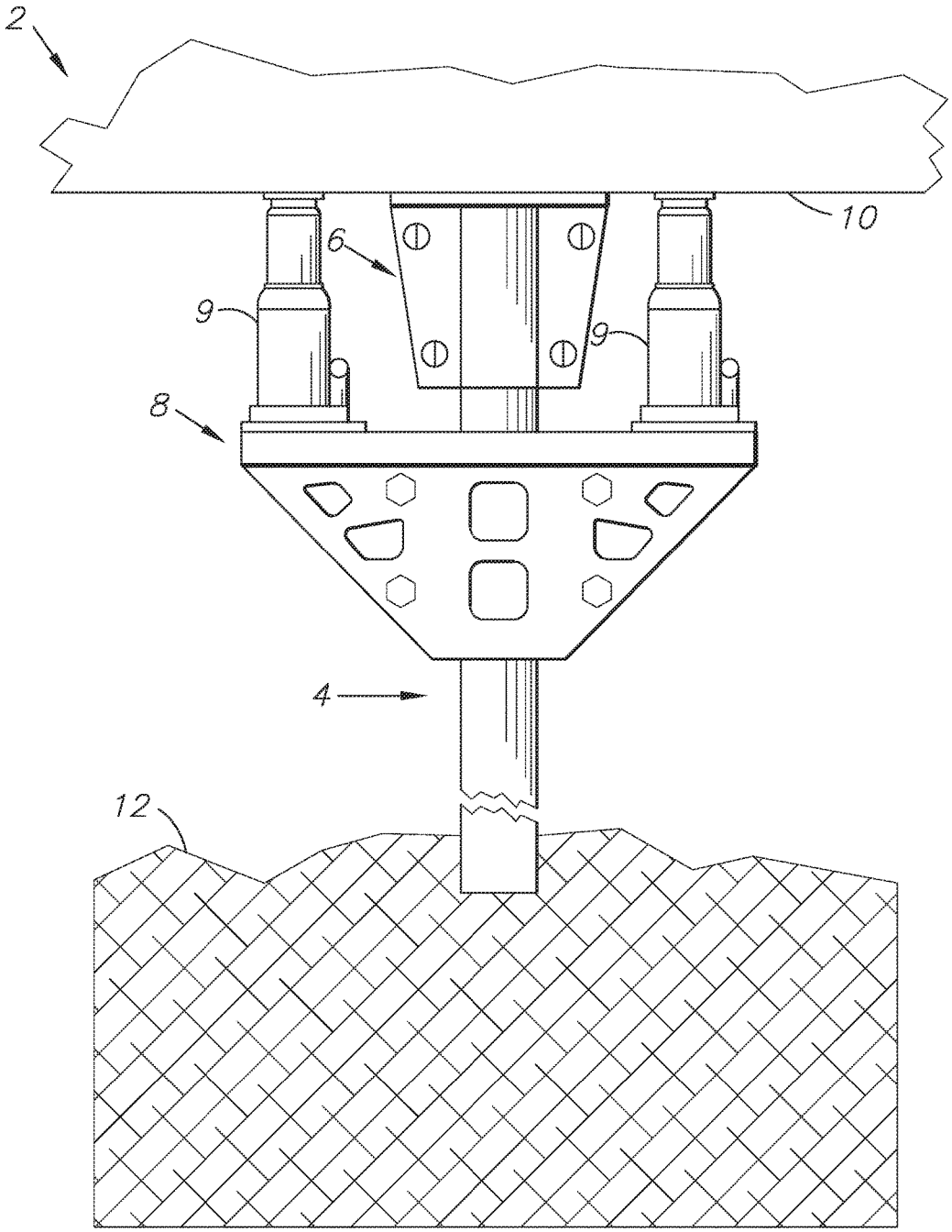
FIG. 1 is a front elevational view of a preferred embodiment of the present invention showing a lifting platform engaging a pier column and a structure.

Referring to the figures, FIG. 1 shows a complete foundation pier system 2, including generally a concentrically aligned pier column 4, a pier cap 6, and a lifting platform 8 mounting a pair of jacks 9 for lifting the structure 10 when the cap 6 is being installed. The lifting platform is configured to be removed after installation of the cap 6. The pier column 4 reaches bedrock 12 or suitably solid earth far below the structure 10 in a preferred embodiment to provide structural stability.

Figure 2:
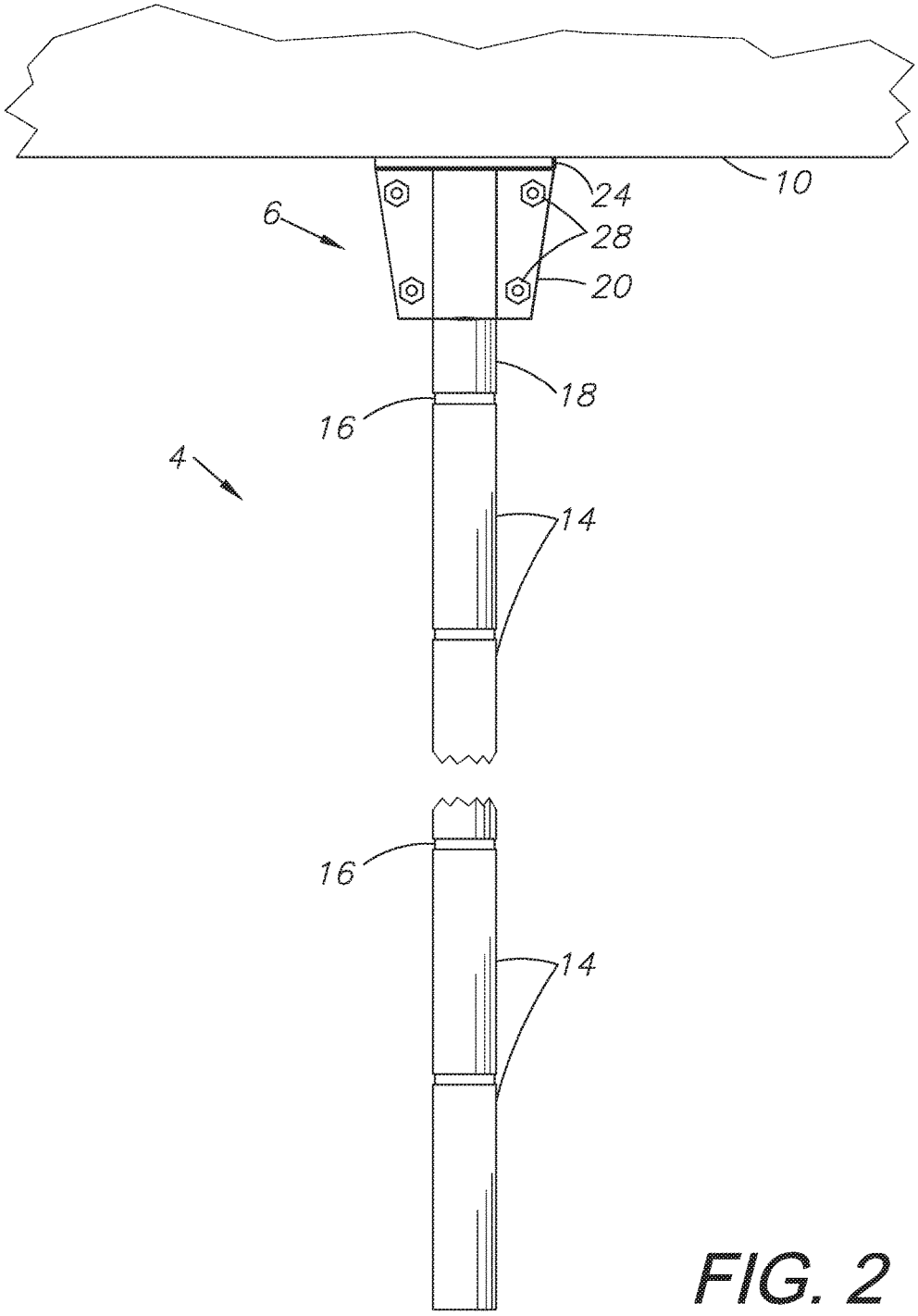
FIG. 2 is a front elevational view of a preferred embodiment of the present invention without the lifting platform.
Figure 3:
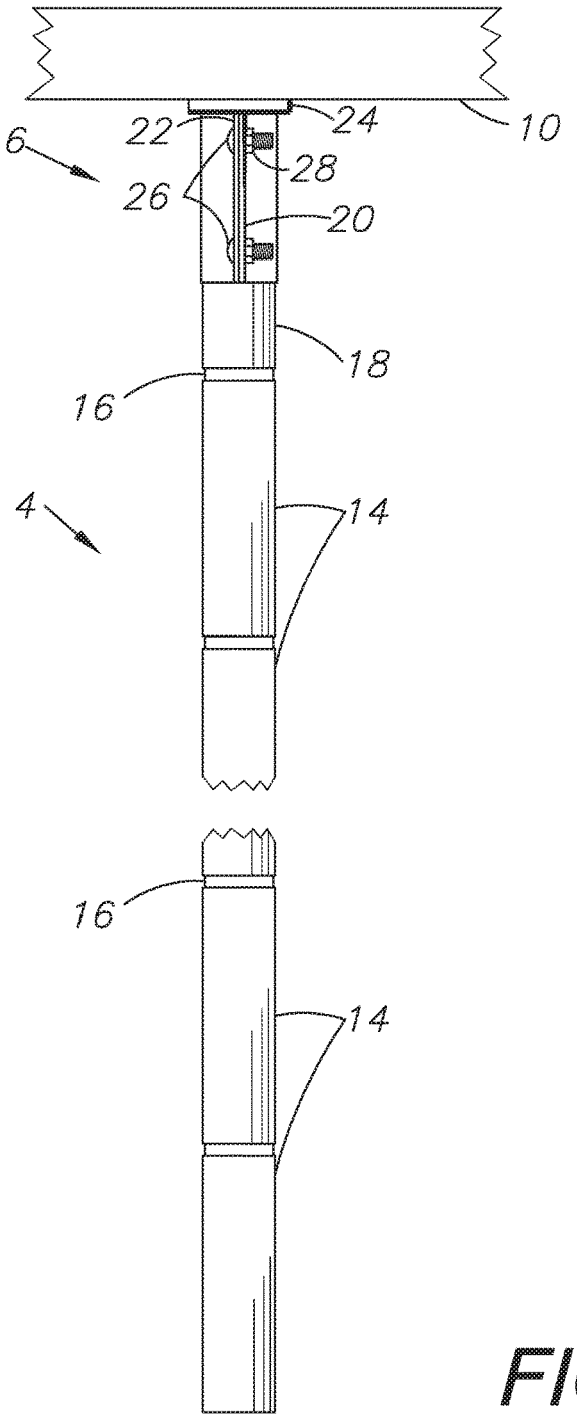
FIG. 3 is a side elevational view thereof.
Figure 4:
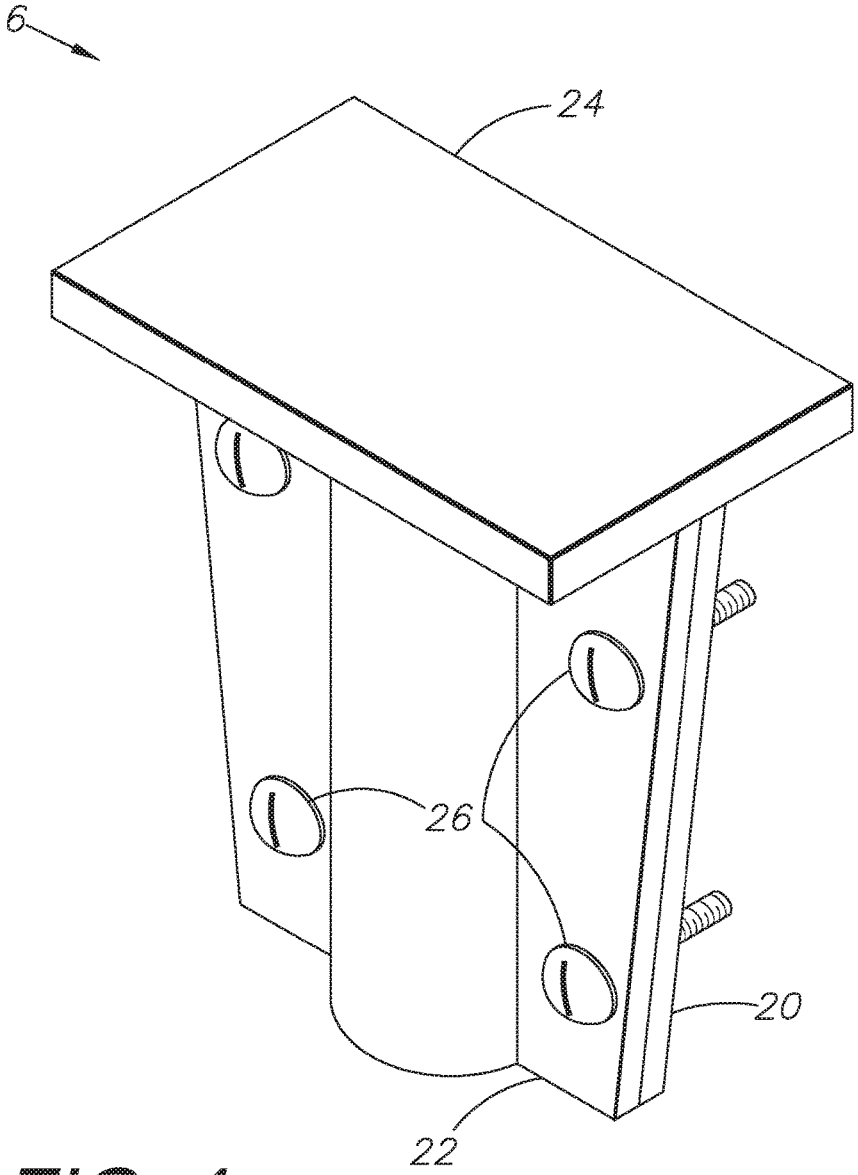
FIG. 4 is a three-dimensional isometric view of a pier cap element of a preferred embodiment of the present invention.
Figure 5:
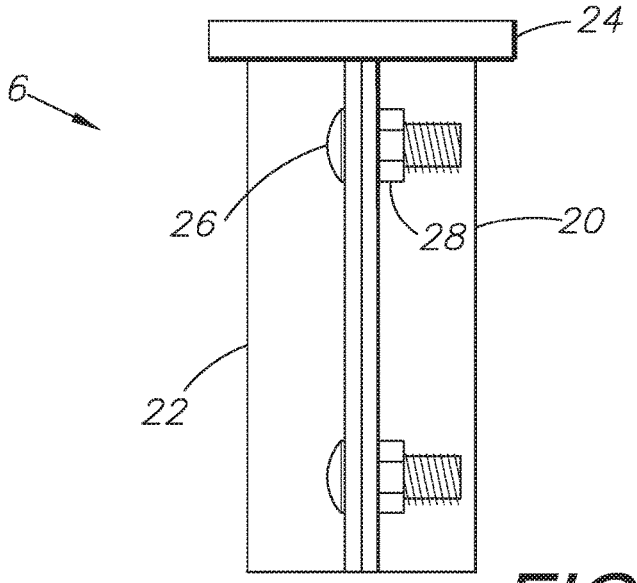
FIG. 5 is a side elevational view thereof.
Figure 6:
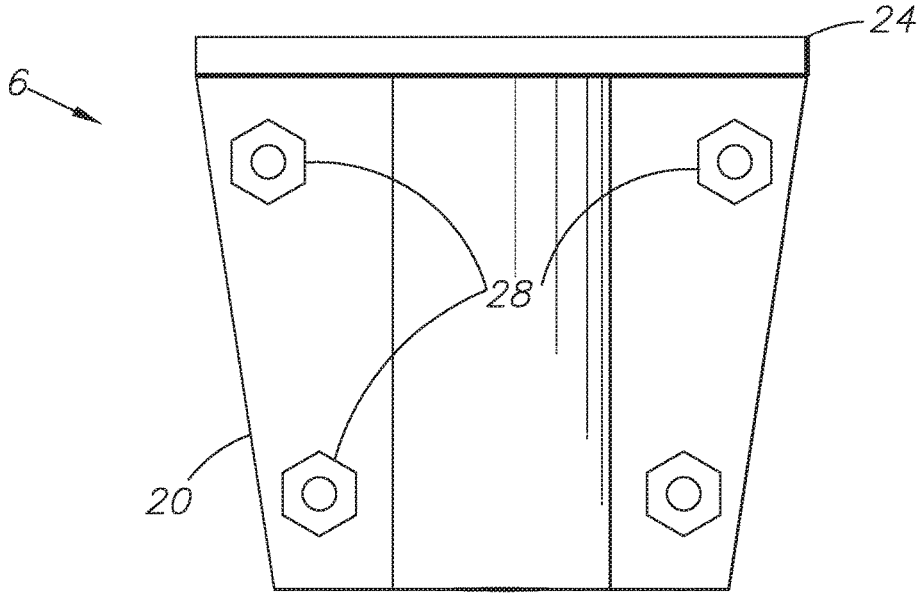
FIG. 6 is a front elevational view thereof.
Figure 7:
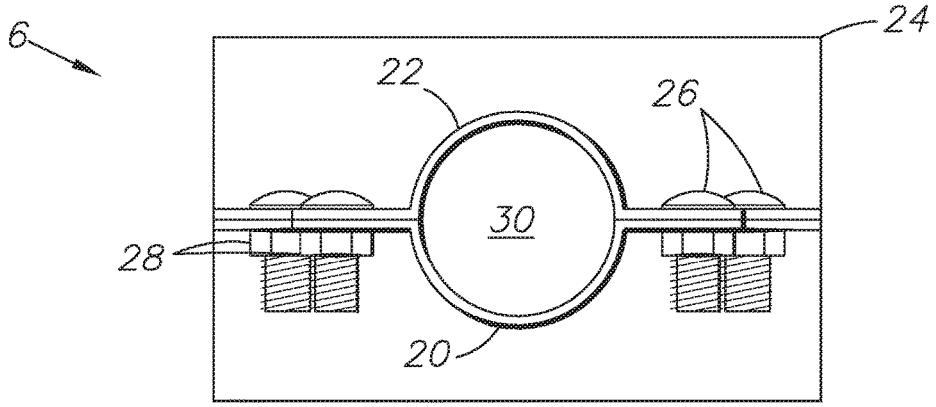
FIG. 7 is a bottom plan view thereof.

FIGS. 2 and 3 shows how the pier cap 6 is installed to the top-most pier 18, which rests upon a number of concentrically stacked pier segments 14, each pier including a tapered top portion 16 for engaging with the base of the next pier in the column. The pier cap 6 is constructed from a top plate 24, a front plate 20, back plate 22, the front and back plates joined with bolts 26 secured by nuts 28. The concentrically stacked pier segments 14 and the top-most pier 18 are formed from steel pipe filled with high-strength concrete. A preferred embodiment may use 0.217 steel pipe. The concentrically loaded structure allows loads to be transferred vertically along a single axis which alleviates any fail points. The front plate 20 is loose, and can be released from the back plate 22 by removing the nuts 28 from the carriage bolts 26.

The pier segments 14 generally include the top-most pier 18 which interfaces with the cap 6, the primary segments 14 as identified in the figures, and a base pier segment which does not have a concave bottom portion, but is instead filled for maximum structural support. The base pier segment is the first of the primary segments 14 put into the ground.

FIGS. 4-8 show the pier cap in more detail, including the receiver space 30 within the finished cap 6 which receives the top-most pier 18. A shim 32 is installed over the top-most pier 18 which prevents shifting of the foundation system 2 when the earth and soil around the system settles or shifts. A second shim 33 may be placed if needed. Additional shims could also be used to fit the space. The shims 32, 33 are contained within the cap 6 and provide a relatively tight seal around the top-most pier 18.

Figure 9:
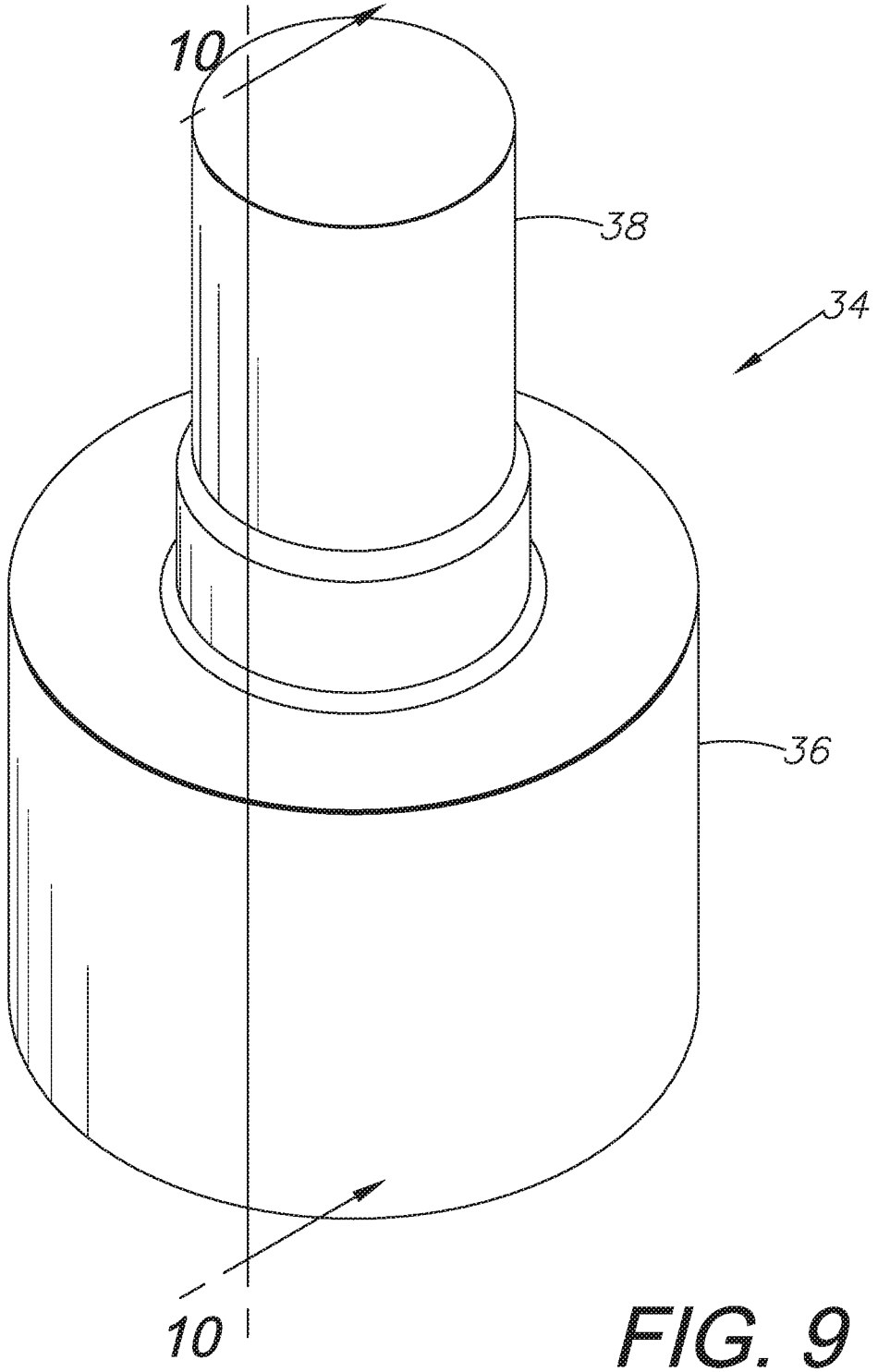
FIG. 9 is a three-dimensional isometric view of a steel and concrete segment adapter for connecting an embodiment of the present invention to an all-concrete segment.
Figure 10:
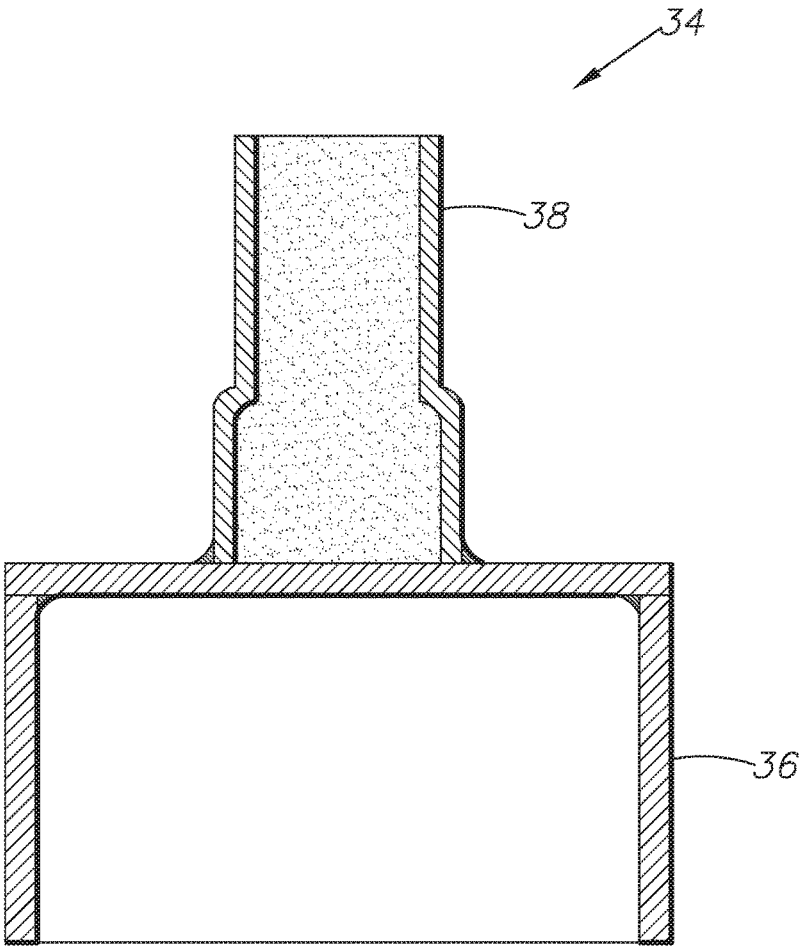
FIG. 10 is a sectional view thereof taken about the line of FIG. 9.
Figure 11:
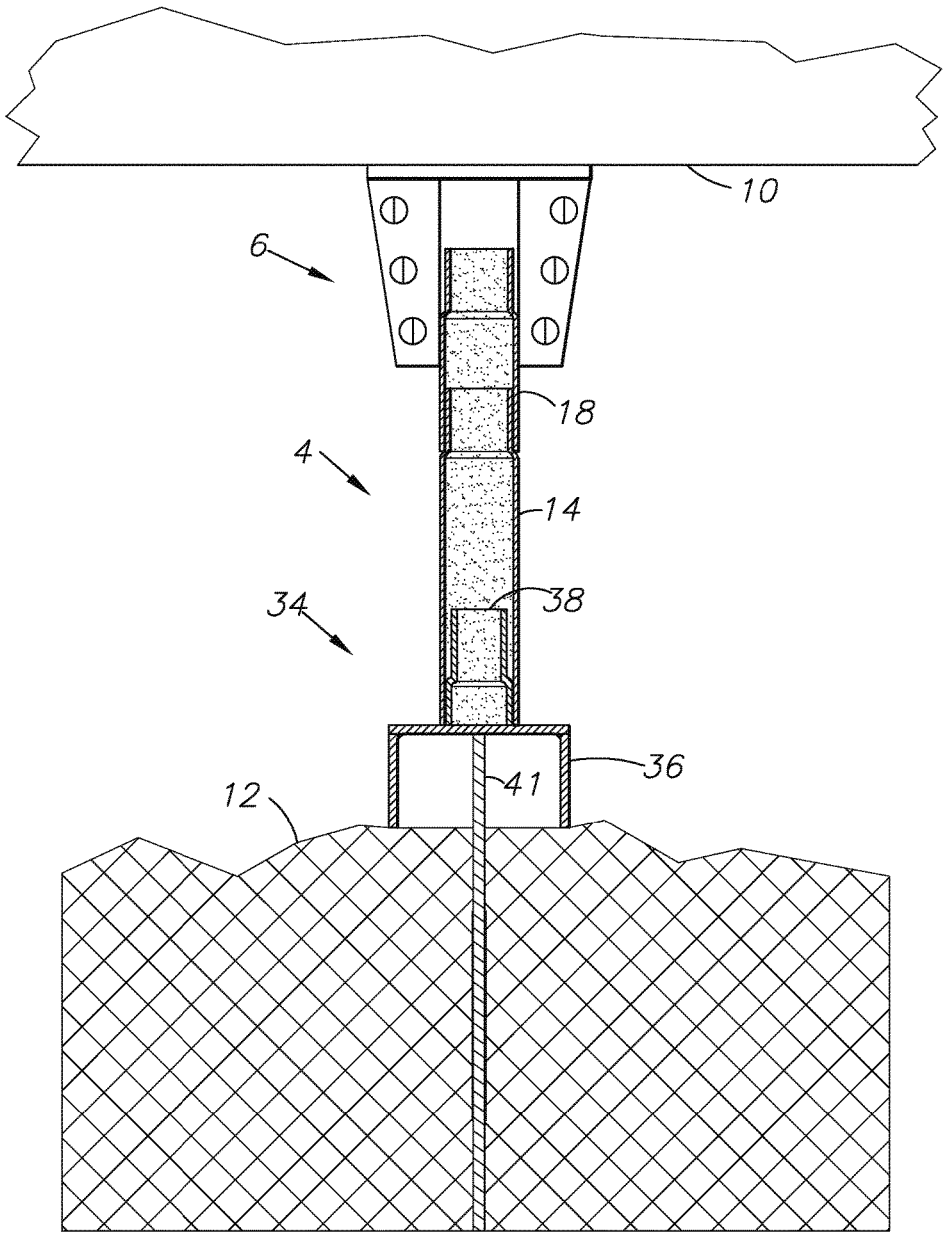
FIG. 11 is a sectional view showing the element of FIG. 9 encompassed in the preferred embodiment of FIGS. 1-8.

FIGS. 9-10 show an adapter subsystem 34 which receives the concentrically stacked pier column 4 and interfaces it with an existing concrete friction pier 60 made of concrete pier segments 60 supported by a rebar alignment retention pin 41 as shown in FIG. 11. As shown in FIG. 11, the adapter base 36 is aligned with the other structure of concrete pier segments 60 for the concentrically stacked pier column 4 to remain substantially vertically oriented, thereby functioning at a designed level.

The adapter base 36 includes a receiver 38 for receiving the base of the bottom-most pier in the pier column 4, similar to the tapered top portions 16 of the pier segments 14.

Figure 12:
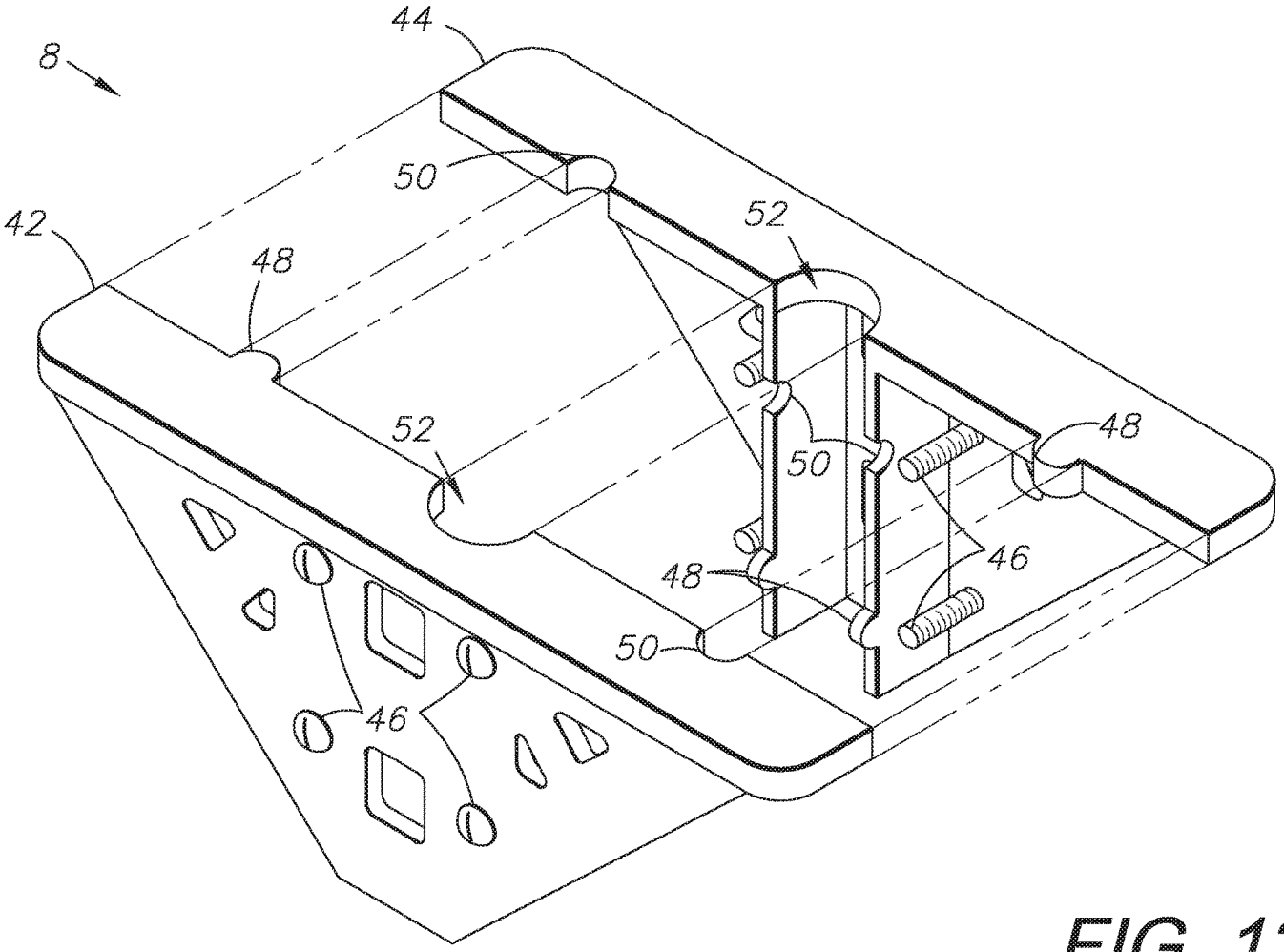
FIG. 12 is an exploded three-dimensional isometric view of a lifting platform assembly element of a preferred embodiment of the present invention.
Figure 13:
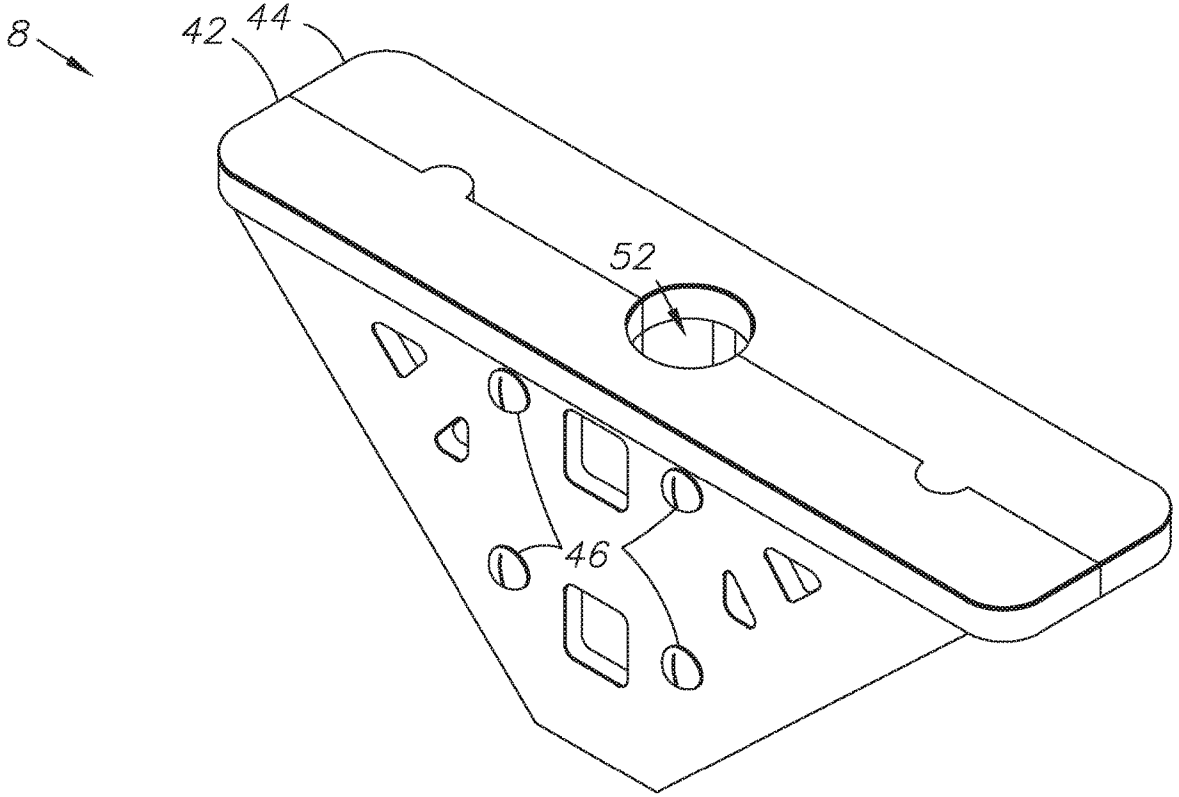
FIG. 13 is a three-dimensional isometric view thereof, showing the lifting platform assembled.
Figure 14:
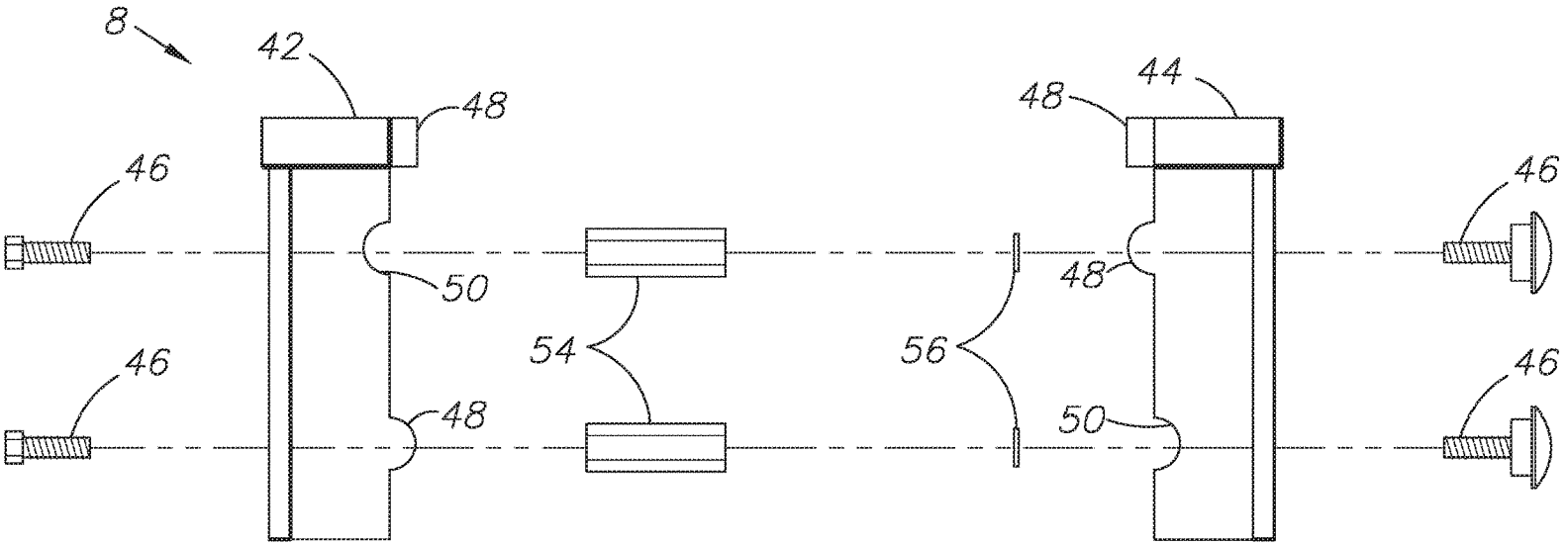
FIG. 14 is a side elevational view thereof, showing the lifting platform in a disassembled state.
Figure 15:
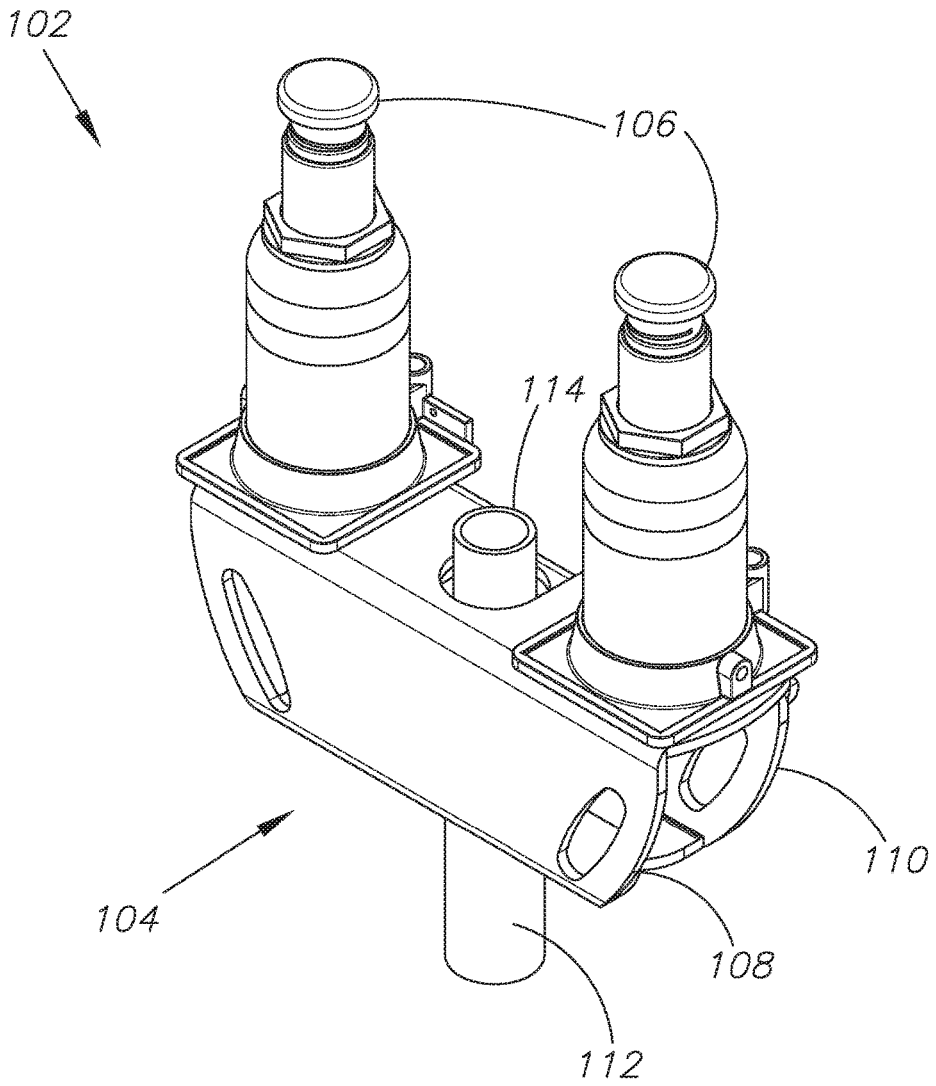
FIG. 15 is a three-dimensional isometric view of an alternative embodiment of the present invention.
Figure 16:
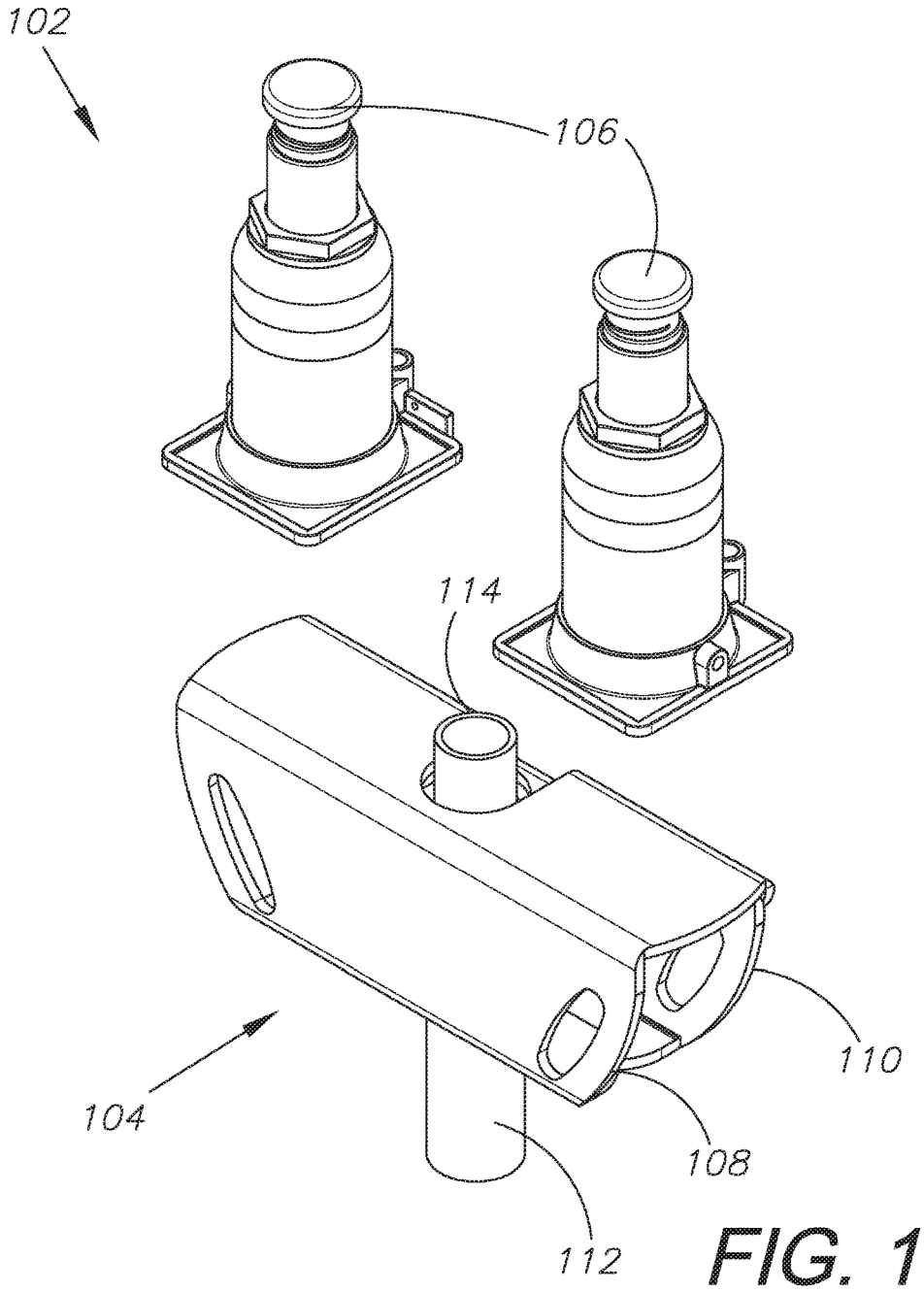
FIG. 16 is a partially exploded three-dimensional isometric view thereof.

FIGS. 12-14 show the lifting platform 8 which is primarily constructed from a front platform plate 42 and a rear platform plate 44 connected together via several mounting bolts 46 threaded into receivers 54 and washers 56 spaced between the front platform plate 42 and the rear platform plate 44 as shown in FIG. 14. The front 42 and rear 44 platform plates include corresponding alignment joint inserts 48 and alignment joint recesses 50 to ensure the two plates are aligned properly. A pier recess 52 is formed between the front 42 and rear 44 platform plates, such that the lifting platform 8 can be installed around one of the concentrically stacked pier segments 14. As shown in FIG.

Figure 8:
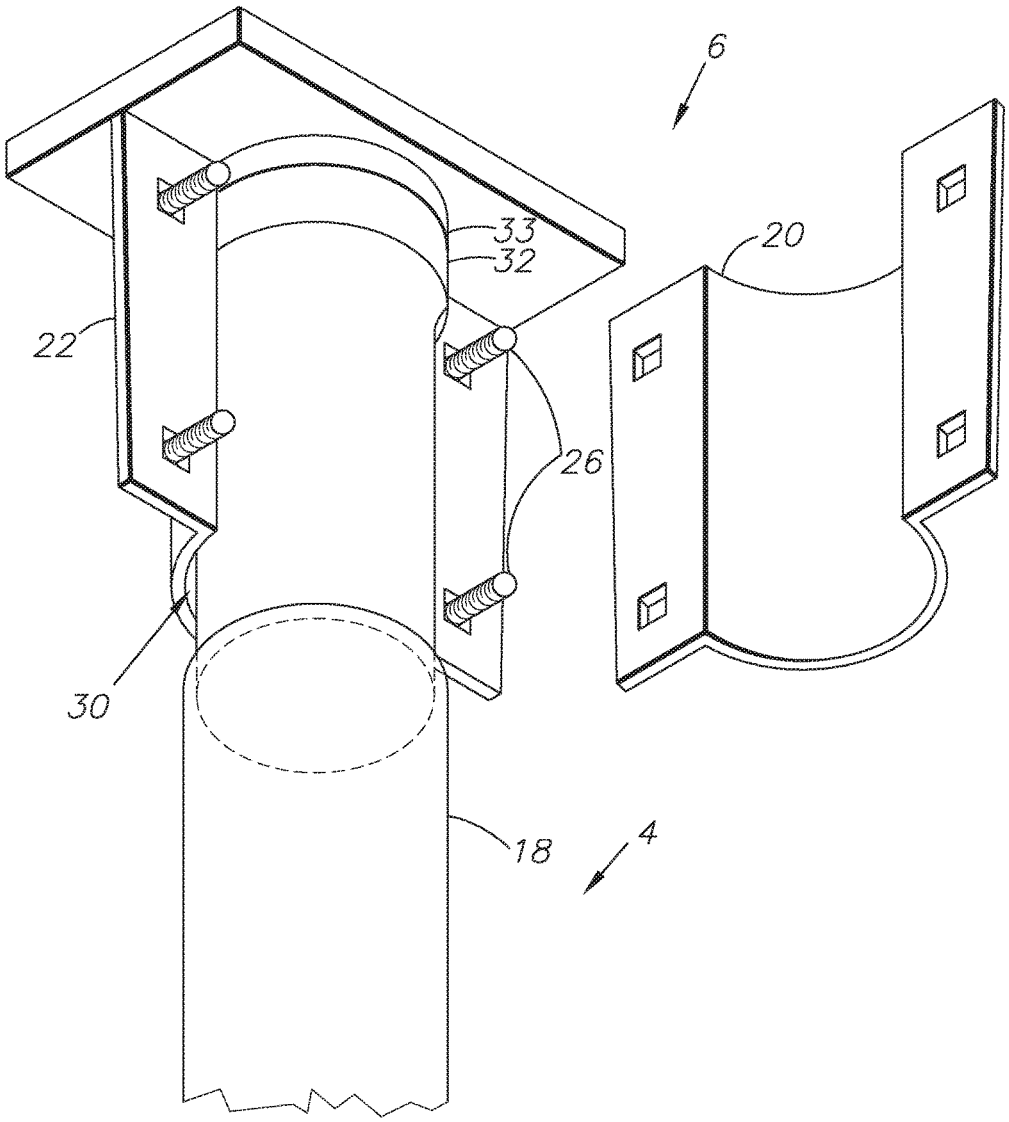
FIG. 8 is a three-dimensional isometric view thereof showing the pier cap from below, a portion of the pier cap being removed and demonstrating how the pier cap encapsulates the pier column.

1, jacks 9 are placed atop the lifting platform 8 once the platform is installed, and the jacks can be used to raise the structure 10 such that the pier cap 6 can be installed as shown in FIG. 8.

III. Method of Installation of Foundation Pier System 2

In a preferred embodiment, the present invention is installed underneath of a structure 10 to provide structural support. The process is begun by digging approximately a 3'×3' hole to access the bottom of the footing/beam. This may be achieved from inside or outside of the structure. 28 inches of working room below the footing/beam is required. These present invention is not limited to these dimensions, as larger or smaller scaled versions of the present invention may require more or less space.

The pier 4 segments 14 are installed into the earth using a hydraulic pump. The pier segments 14 are interlocked via the top-portions 16 of each pier interlocking with the base of the next pier above it. This allows the concentric load to be transferred from concrete to concrete along the pier structure 4. The pier segments 14 are driven into the ground one at a time. This process is repeated until bedrock, load-bearing strata, or the friction adapter subsystem 34 are reached. Because the segments are driven directly underneath the footing of the structure 10, the foundation is not jeopardized or damaged due to bolting to or cutting into the footing.

The lifting platform assembly 8 is temporarily attached to the pier structure 4 to lift the structure 10 via the jacks 9 or other methods. For example, a manifold lifting system may also be used. Once the structure 10 has been lifted, the pier cap 6 is placed over the top-most pier 18, along with the shim(s) 32, 33. The shims are contained within the pier cap to prevent future shifting of the foundation pier system 2. The finished pier is then installed, the lifting platform assembly 8 and jacks 9 are removed, and the structure is suitably supported.

IV. Alternative Embodiment Foundation Pier System 102

Figure 18:
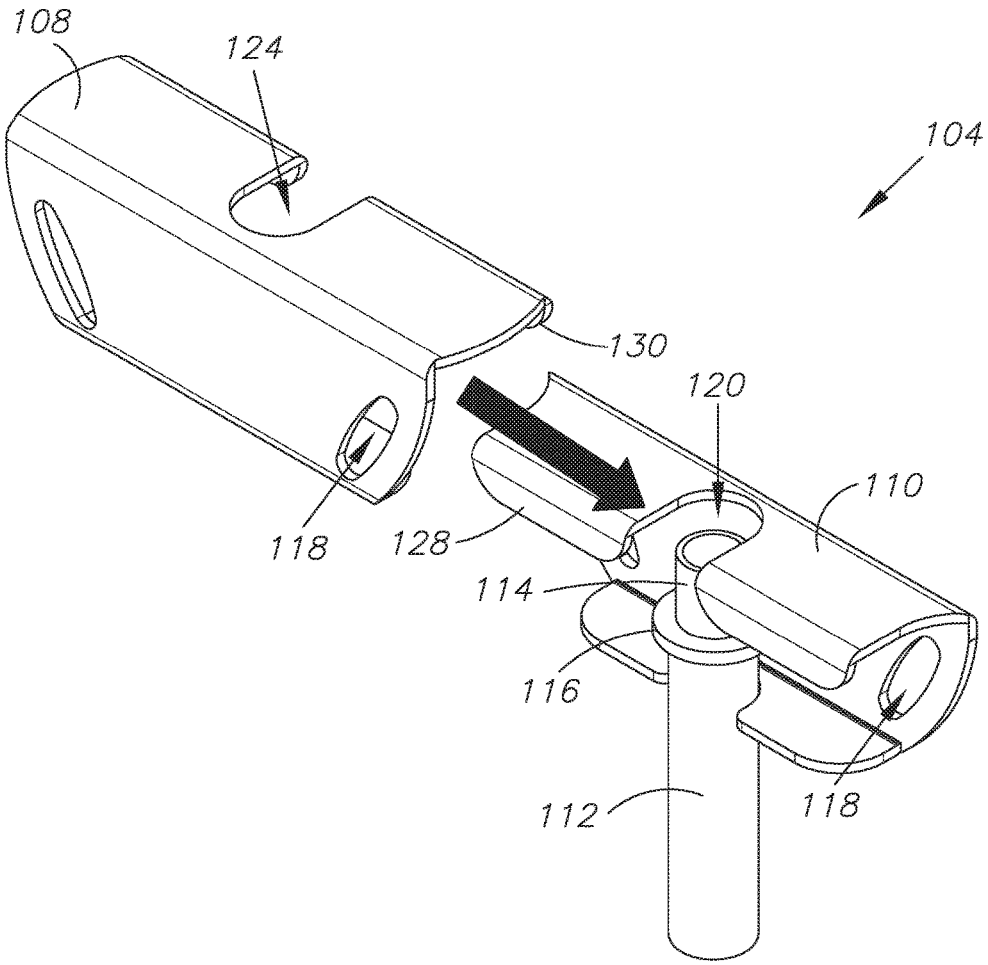
FIG. 18 is a continuation of FIG. 17 showing the assembly of the elements thereof.
Figure 19:
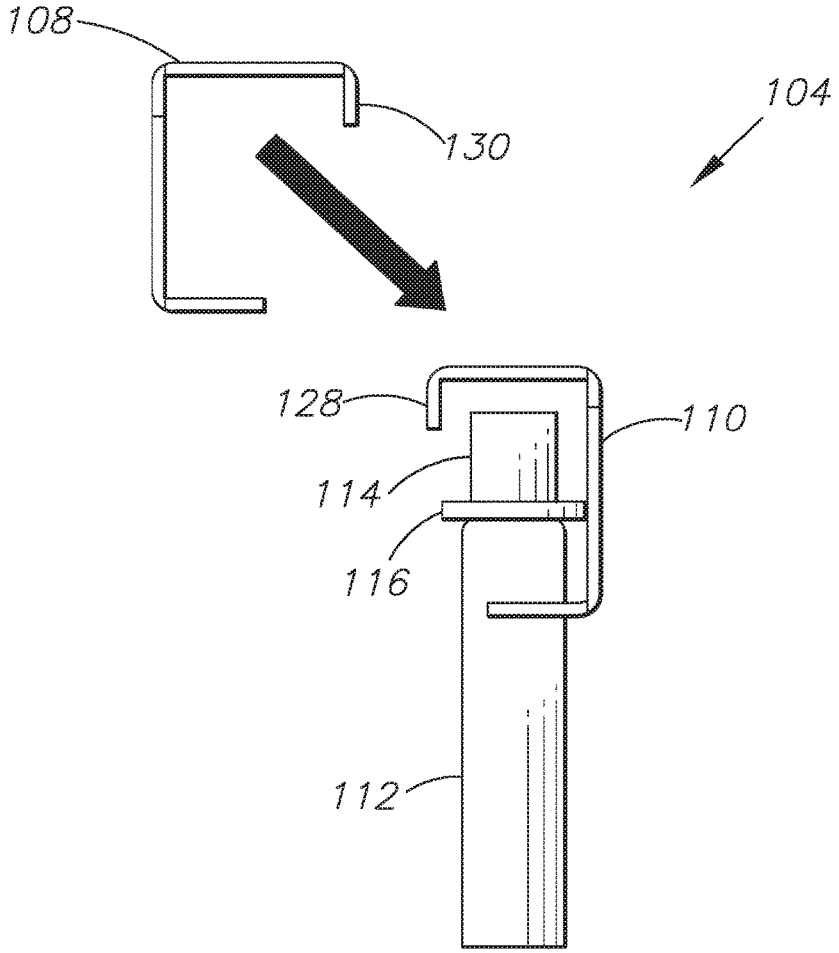
FIG. 19 is a side elevational view thereof.
Figure 20:
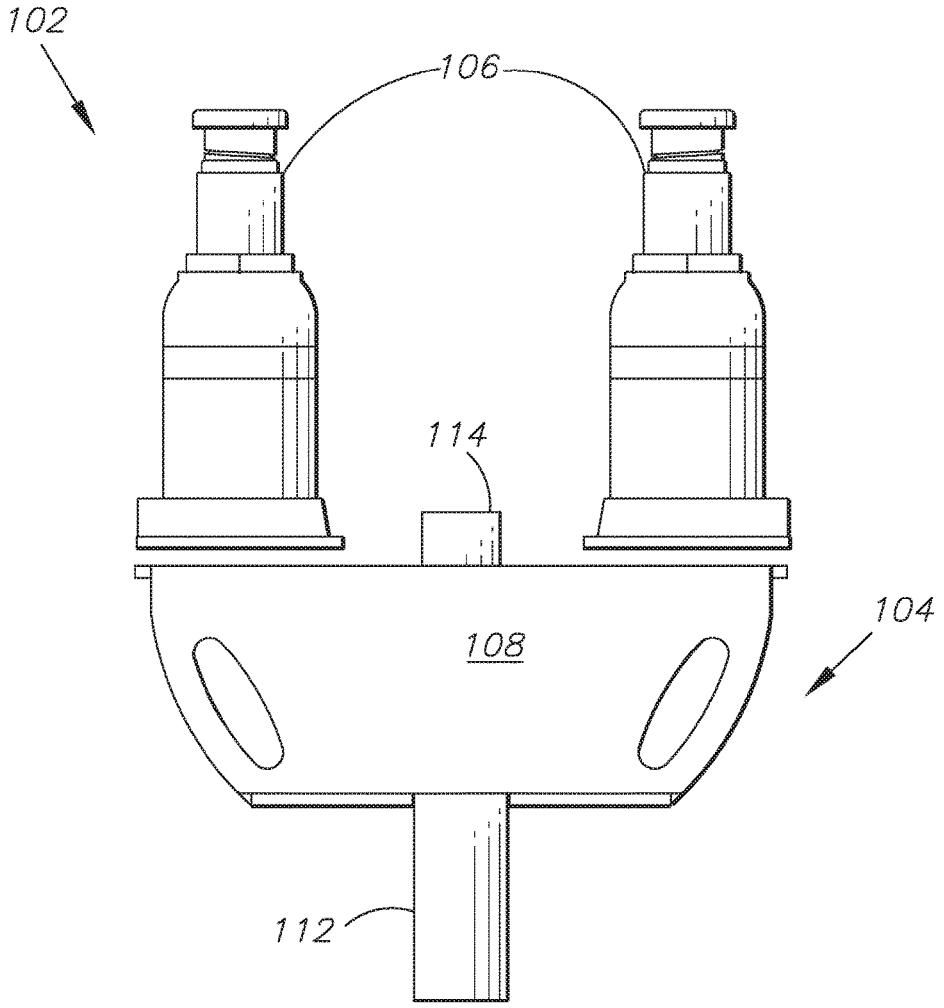
FIG. 20 is a front elevational view of the embodiment of FIG. 15.
Figure 21:
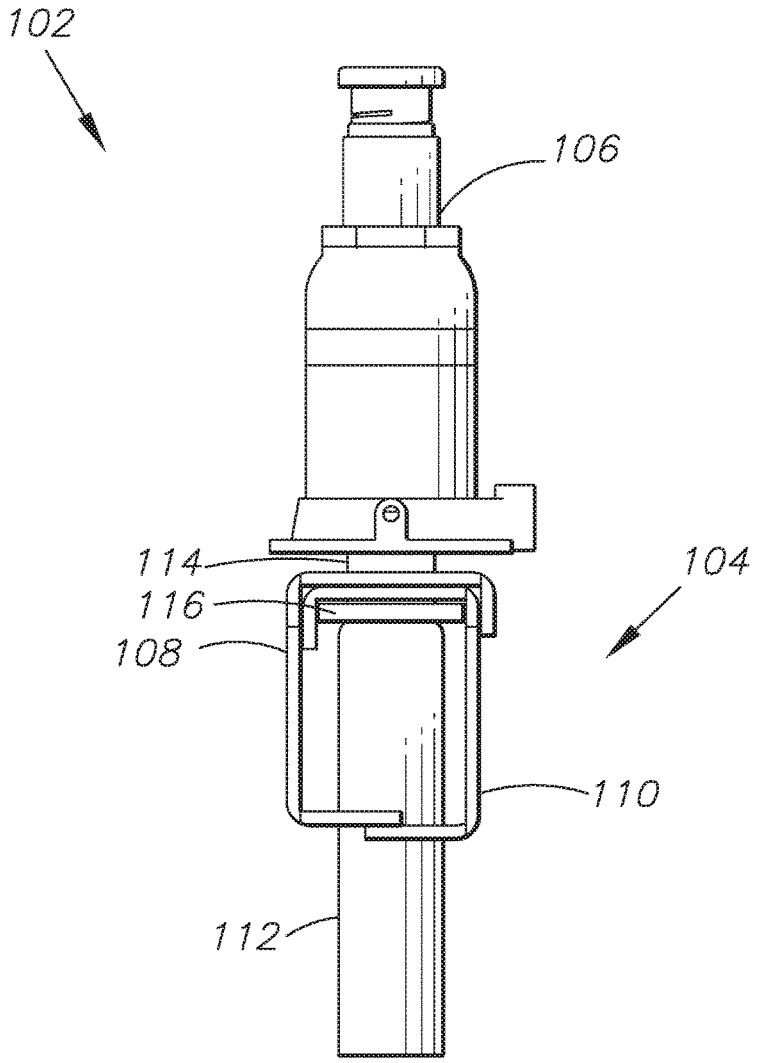
FIG. 21 is a side elevational view thereof.
Figure 22:
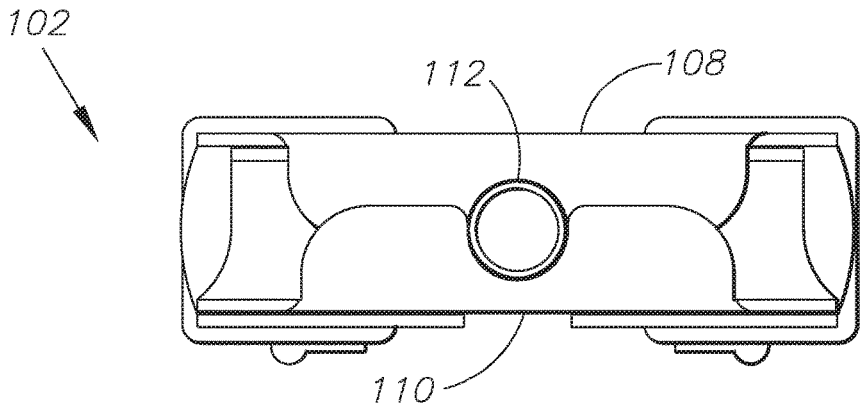
FIG. 22 is a bottom plan view thereof.
Figure 23:
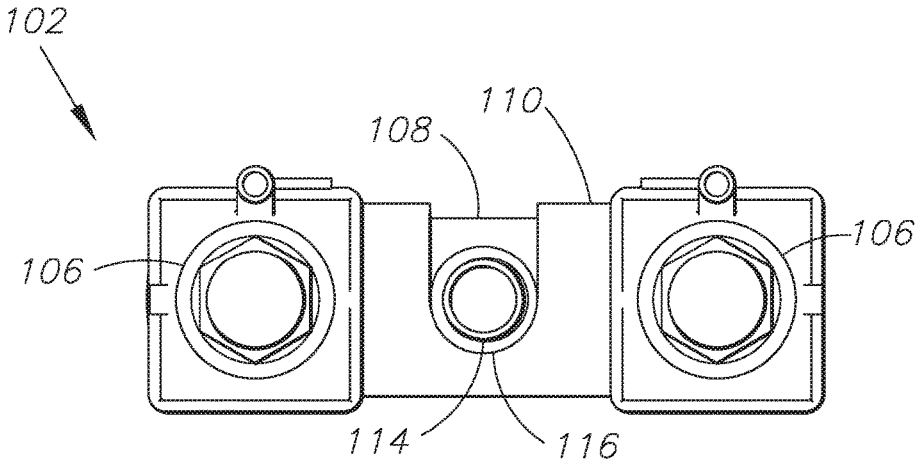
FIG. 23 is a top plan view thereof.

FIGS. 15-23 show an alternative embodiment foundation pier system 102 including a platform lifting assembly 104 mounting a pairs a pair of jacks 106. The platform assembly has a top plate 108 which overlaps with a bottom plate 110 over the tapered top portion 114 of a pier segment 112. As in the embodiment above, this would be fitted over the top-most pier segment in a series of piers. As shown in FIG. 20, the jacks 106 can be placed on top of platform lifting assembly 104.

Figure 17:
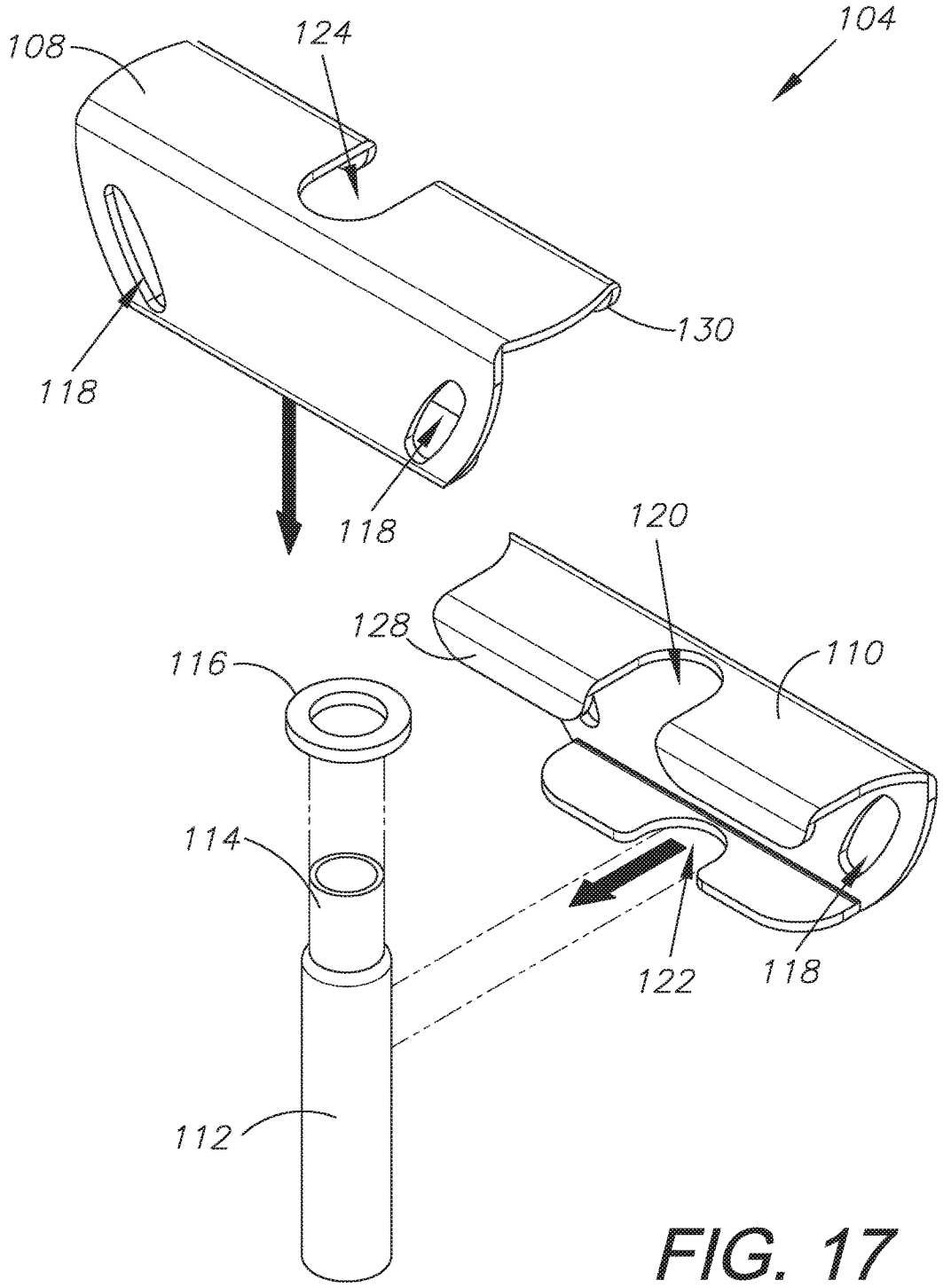
FIG. 17 is a partially exploded three-dimensional isometric view of a platform element thereof.

FIGS. 17-19 show how the platform lifting assembly 104 is assembled. The bottom plate 110 is placed about the pier segment 112 in proximity with the tapered top portion 114, an upper 120 and lower 122 receiver fitting about the circumference of the segment. A collar 116 is placed over the top portion 114 within the bottom plate 110. The top plate 108 is then placed over the bottom plate 110 using similar upper 124 and lower (not shown) receivers. The top 108 plate has a lip 130 which interlocks over a side of the bottom plate 110, the bottom plate 110 also has a lip 128 which is placed against an interior face of the top plate 108. Cutouts 118 of the plates 108, 110 allow for easy hand-hold grips for positioning the plates about the pier segment 112.

This platform lifting assembly 104 can be installed about the upper portion of a pier segment 112 without the need for bolts or other fasteners. The two plates 108, 110 interlock about the pier segment 112 and collar 116 in such a manner that no such fasteners are required and use of the jacks 106 will not cause the two plates to come apart.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A foundation pier system comprising:

a base pier segment, a top pier segment, and a plurality of primary foundation pier segments;

a pier cap assembly configured to encompass at least a portion of said top pier segment, said pier cap assembly engaged with a structural element;

said pier cap assembly comprising a first plate and a second plate;

at least one shim installed within said pier cap assembly and about said top-most pier segment;

a lifting platform configured to be temporarily installed about at least one of said plurality of primary foundation pier segments, said lifting platform configured to support a lifting assembly configured to lift said structural element such that said pier cap assembly may be installed and said lifting platform, said lifting platform comprising an interlocking first plate and second plate, wherein said first plate and second plate are assembled to form said lifting platform without fasteners;

said plurality of primary foundation pier segments each including a top portion and a base portion, said top portion of each said plurality of primary foundation pier segments configured to be engaged with the base portion of another of said plurality of primary foundation pier segments or a base portion of said top pier segment;

said base pier segment comprising a top portion configured to be engaged with one of the base portions of said plurality of primary foundation pier segments; and said plurality of primary foundation pier segments stacked concentrically such that a single vertical axis of support is created through said plurality of primary foundation pier segments.

2. The foundation pier system of claim 1, further comprising:

an adapter base configured to rest atop a previously placed concrete friction pier section located in the ground;

said base pier segment including a partially hollow base portion; and said adapter base including a receiver inserted into said base pier segment partially hollow base portion, thereby securing said base pier segment.

3. The foundation pier system of claim 2, further comprising:

said adapter base including a lower portion configured to rest on top of and partially receive a top end of said concrete friction pier section.

4. The foundation pier system of claim 1, further comprising:

said first plate of pier cap assembly comprised of a back plate and a top plate, wherein said back plate and said top plate are rigidly affixed together, said second plate of said pier cap assembly comprised of a front plate, said front plate is removably affixed to said back plate by a plurality of carriage bolts and nuts;

said top pier segment including a top portion configured to be received at least partially within said pier cap assembly; and wherein said at least one shim is placed over said top portion of said top pier segment within said pier cap assembly such that said pier cap assembly presses said at least one shim firmly between said pier cap assembly and said top portion of said top pier segment.

5. The foundation pier system of claim 1, further comprising:

said first plate of said lifting assembly having a top side and a rear side meeting at a 90° bend thereby forming a generally "L" shape, a top lip perpendicular to said top side and a bottom lip perpendicular to said rear side;

said second plate of said lifting assembly having a top side and a rear side meeting at a 90° bend thereby forming a generally "L" shape, a top lip perpendicular to said top side and a bottom lip perpendicular to said rear side;

said first plate top lip configured for engaging with an outer face of said second plate about said 90° bend thereof;

said second plate top lip configured for engaging with an inner face of said first plate about said 90° bend thereof; and said first plate bottom lip configured to rest atop said second plate bottom lip.

6. The foundation pier system of claim 5, further comprising:

said lifting assembly comprising a pair of jacks configured for temporary placement on a top face of said lifting platform; and wherein said pair of jacks are configured to at least marginally lift said structural element away from said lifting assembly to allow for installation of said pier cap assembly and said at least one shim.

7. The foundation pier system of claim 5, further comprising:

said first plate and said second plate each including a plurality of alignment joint inserts and alignment joint recesses configured to align said first plate and said second plate when installed.

8. The foundation pier system of claim 1, wherein said top pier segment, said primary pier segments, and said base pier segment are concentrically aligned.

9. A method of providing structural support to a building structure, the method comprising the steps:

installing a base pier segment into the earth beneath a portion of a building structure, said base pier segment including a top portion;

installing at least one primary foundation pier segment above said base pier segment, wherein each of said at least one primary foundation pier segments includes a base portion and a top portion, and wherein a first of said base portion of said at least one primary foundation pier segments is configured to receive said top portion of said base pier segment, and wherein said top portion of said at least one primary foundation pier segment is configured to be received within a base portion of another primary foundation pier segment or a base portion of a top pier segment;

installing said top pier segment above said at least one primary foundation pier segment, said top pier segment including a top portion;

installing a temporary lifting platform about one of said top pier segment or said at least one primary foundation pier segment, said temporary lifting platform comprising an interlocking first plate and second plate, wherein said first plate and second plate are assembled to form said temporary lifting platform without fasteners;

placing a lifting assembly on a top face of said temporary lifting platform and temporarily lifting said structure away from said lifting platform with said lifting assembly;

installing a pier cap about said top portion of said top pier segment;

installing at least one shim about said to portion of said top pier segment, wherein said at least one shim is contained within said pier cap;

lowering said structure with said lifting assembly;

removing said lifting assembly and said temporary lifting platform;

wherein said first plate of said temporary lifting assembly having a top side and a rear side meeting at a 90° bend thereby forming a generally "L" shape, a top lip perpendicular to said top side and a bottom lip perpendicular to said rear side;

wherein said second plate of said temporary lifting assembly having a top side and a rear side meeting at a 90° bend thereby forming a generally "L" shape, a top lip perpendicular to said top side and a bottom lip perpendicular to said rear side;

wherein said first plate top lip configured for engaging with an outer face of said second plate about said 90° bend thereof;

wherein said second plate top lip configured for engaging with an inner face of said first plate about said 90° bend thereof;

wherein said first plate bottom lip configured to rest atop said second plate bottom lip;

wherein said lifting assembly comprising a pair of jacks configured for temporary placement on a top face of said lifting platform; and wherein said pair of jacks are configured to at least marginally lift said structure away from said lifting assembly to allow for installation of said pier cap and said at least one shim.

10. The method of claim 9, wherein:

said first plate and said second plate each including a plurality of alignment joint inserts and alignment joint recesses configured to align said first plate and said second plate when installed.

11. The method of claim 9, wherein:

an adapter base configured to rest atop a previously placed concrete friction pier section located in the ground;

said base pier segment including a partially hollow base portion; and said adapter base including a receiver inserted into said base pier segment partially hollow base portion, thereby securing said base pier segment.

12. The method of claim 11, wherein:

said adapter base including a lower portion configured to rest on top of and partially receive a top end of said concrete friction pier section.

13. A method of providing structural support to a building structure, the method comprising the steps:

installing a base pier segment into the earth beneath a portion of a building structure, said base pier segment including a top portion;

installing at least one primary foundation pier segment above said base pier segment, wherein each of said at least one primary foundation pier segments includes a base portion and a top portion, and wherein a first of said base portion of said at least one primary foundation pier segments is configured to receive said top portion of said base pier segment, and wherein said top portion of said at least one primary foundation pier segment is configured to be received within a base portion of another primary foundation pier segment or a base portion of a top pier segment;

installing said top pier segment above said at least one primary foundation pier segment, said top pier segment including a top portion;

installing a temporary lifting platform about one of said top pier segment or said at least one primary foundation pier segment, said temporary lifting platform comprising an interlocking first plate and second plate, wherein said first plate and second plate are assembled to form said temporary lifting platform without fasteners;

placing a lifting assembly on a top face of said temporary lifting platform and temporarily lifting said structure away from said lifting platform with said lifting assembly;

installing a pier cap about said top portion of said top pier segment;

installing at least one shim about said to portion of said top pier segment, wherein said at least one shim is contained within said pier cap;

lowering said structure with said lifting assembly;

removing said lifting assembly and said temporary lifting platform;

said pier cap comprising a front plate, a back plate, and a top plate, wherein said back plate and said top plate are rigidly affixed together and said front plate is removably affixed to said back plate by a plurality of carriage bolts and nuts;

said top pier segment including a top portion configured to be received at least partially within said pier cap; and wherein said at least one shim is placed over said top portion of said top pier segment within said pier cap such that said pier cap presses said at least one shim firmly between said pier cap and said top portion of said top pier segment.

* * * * *